US007044616B2

(12) United States Patent
Shih

(10) Patent No.: US 7,044,616 B2
(45) Date of Patent: May 16, 2006

(54) SOLAR POWERED WARNING LIGHT DEVICE

(76) Inventor: Yi Cyuan Shih, P.O. Box 63-298, Taichung, 406 (TW)

( * ) Notice: Subject to any disclaimer, the term of this patent is extended or adjusted under 35 U.S.C. 154(b) by 0 days.

(21) Appl. No.: 10/938,936

(22) Filed: Sep. 13, 2004

(65) Prior Publication Data

US 2006/0056171 A1 Mar. 16, 2006

(51) Int. Cl.
*F21V 33/00* (2006.01)

(52) U.S. Cl. ..... 362/135; 362/138; 362/183; 362/276

(58) Field of Classification Search ..... 362/183, 362/191, 276, 802, 812, 135, 138, 140; 404/6
See application file for complete search history.

(56) References Cited

U.S. PATENT DOCUMENTS 5,101,329 A * 3/1992 Doyle ..... 362/183
5,453,729 A * 9/1995 Chu ..... 362/183
5,580,156 A 12/1996 Suzuki et al. ..... 362/184
5,782,552 A * 7/1998 Green et al. ..... 362/183
5,890,794 A * 4/1999 Abtahi et al. ..... 362/183
6,031,468 A * 2/2000 Tsao et al. ..... 362/183

FOREIGN PATENT DOCUMENTS

JP 11142632 A * 5/1999

* cited by examiner

*Primary Examiner*—Stephen F Husar

(57) ABSTRACT

A solar powered warning light device includes a housing having a front orifice, a solar panel disposed on top of the housing to receive solar energy, a circuit board disposed in the housing and having a converting device coupled to the solar panel, to receive and to convert the solar energy into electric energy and stored in one or more capacitors. The circuit board includes one or more light devices coupled to and energized by the capacitor, and engaged in the orifice of the housing, to emit light out of the housing. A switch may switch on and off the light device, and a photoactive member is coupled to the electric switch, to operate the electric switch by the light of the environment.

2 Claims, 3 Drawing Sheets

SOLAR POWERED WARNING LIGHT DEVICE

BACKGROUND OF THE INVENTION

1. Field of the Invention

The present invention relates to a solar powered warning light device, and more particularly to a solar powered warning light device for attaching onto objects to light environment without batteries.

2. Description of the Prior Art

Typical road marker devices have been developed and mounted beside roadways, to reflect lights, and/or to generate warning lights, in order to warn people, such as vehicles drivers, and to avoid accidents.

For example, U.S. Pat. No. 5,580,156 to Suzuki et al. discloses one of the typical marker apparatuses including a retroreflector constituted by three reflective surfaces, and a light device disposed on an optical axis of the retroreflector, and a lens is provided in front of the retroreflector, and a condensing lens is formed on the lens for condesing light emitting from the light source.

However, the typical marker apparatuses require to provide one or more batteries and to couple the batteries to the light device, in order to energize the light device. Workers may have to change the batteries from time to time.

Convex lenses have been provided and disposed on corner areas of roads, to allow the users or the drivers to view or to see the other vehicles from the other corner areas of the roads, and to avoid or to prevent car accidents from being happened. However, the convex lenses are normally disposed on the corner areas of the roads where will be dark during night or the like, such that the convex lenses are may not be clearly seen by the drivers during the night, and may have a good chance to be damaged by vehicles.

The present invention has arisen to mitigate and/or obviate the afore-described disadvantages of the conventional warning light devices.

SUMMARY OF THE INVENTION

The primary objective of the present invention is to provide a solar powered warning light device for attaching onto objects to light environment without batteries.

The other objective of the present invention is to provide a solar powered warning light device for attaching onto objects, such as convex lenses or mirrors, to light the dark environment, particularly the dark corner areas of the roads, and to avoid or to prevent car accidents from being happened.

In accordance with one aspect of the invention, there is provided a solar powered warning light device comprising a housing including a chamber formed therein, and including an orifice formed in a front portion thereof, and communicating with the chamber of the housing, a solar panel disposed on top of the housing, to receive solar energy, a circuit board disposed in the chamber of the housing and including a converting device disposed thereon and coupled to the solar panel, to receive solar energy from the solar panel, and to convert the solar energy into electric energy, and including an electric energy storing device coupled to the converting device, to receive and to store the electric energy from the converting device, the circuit board including at least one light device coupled to the electric energy storing device and energized by the electric energy storing device, the light device being engaged in the orifice of the housing, to generate and to emit a light out through the housing, and to light dark environment, an electric switch coupled to the light device, to switch on and off the light device, and a photoactive member coupled to the electric switch, and to be actuated by a light of the environment, in order to operate the electric switch, and then to switch on and off the light device depending on the light of the environment.

The electric energy storing device includes at least one capacitor to receive and to store the electric energy. The housing includes an open top formed therein, the solar panel is received and engaged in the open top of the housing. The solar panel includes an aperture formed therein, to receive the photoactive member, and to allow the photoactive member to be actuated by the light of the environment.

The housing includes at least one flap extended therefrom, for attaching onto objects. A supporting device may further be provided to support the housing, and a fastener device may further be provided for securing the housing on the supporting device. For example, the supporting device may be a convex mirror. The supporting device may include a hood provided on top thereof, to support the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
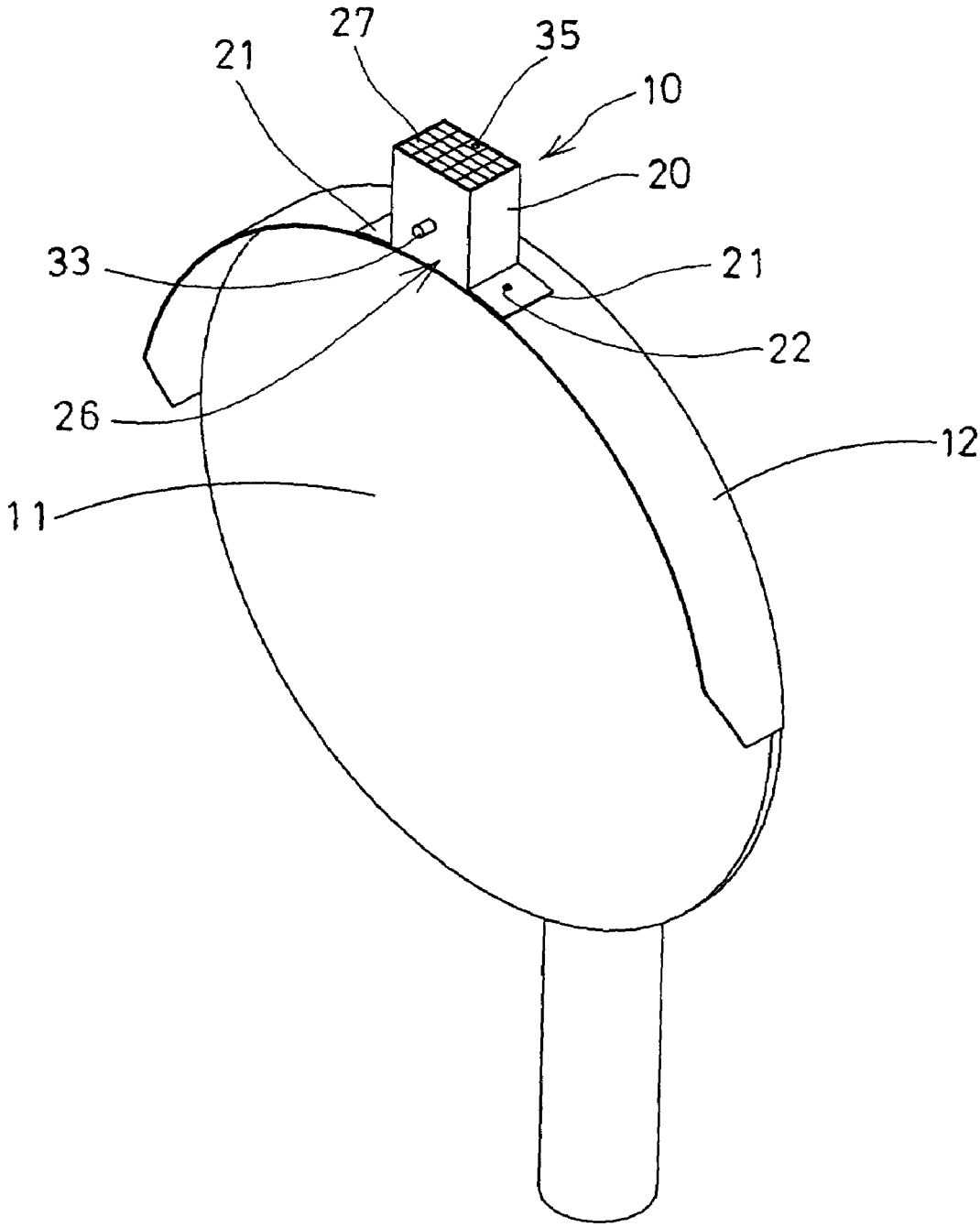
FIG. 1 is a perspective view of a solar powered warning light device in accordance with the present invention, for attaching onto supporting objects.
Figure 2:
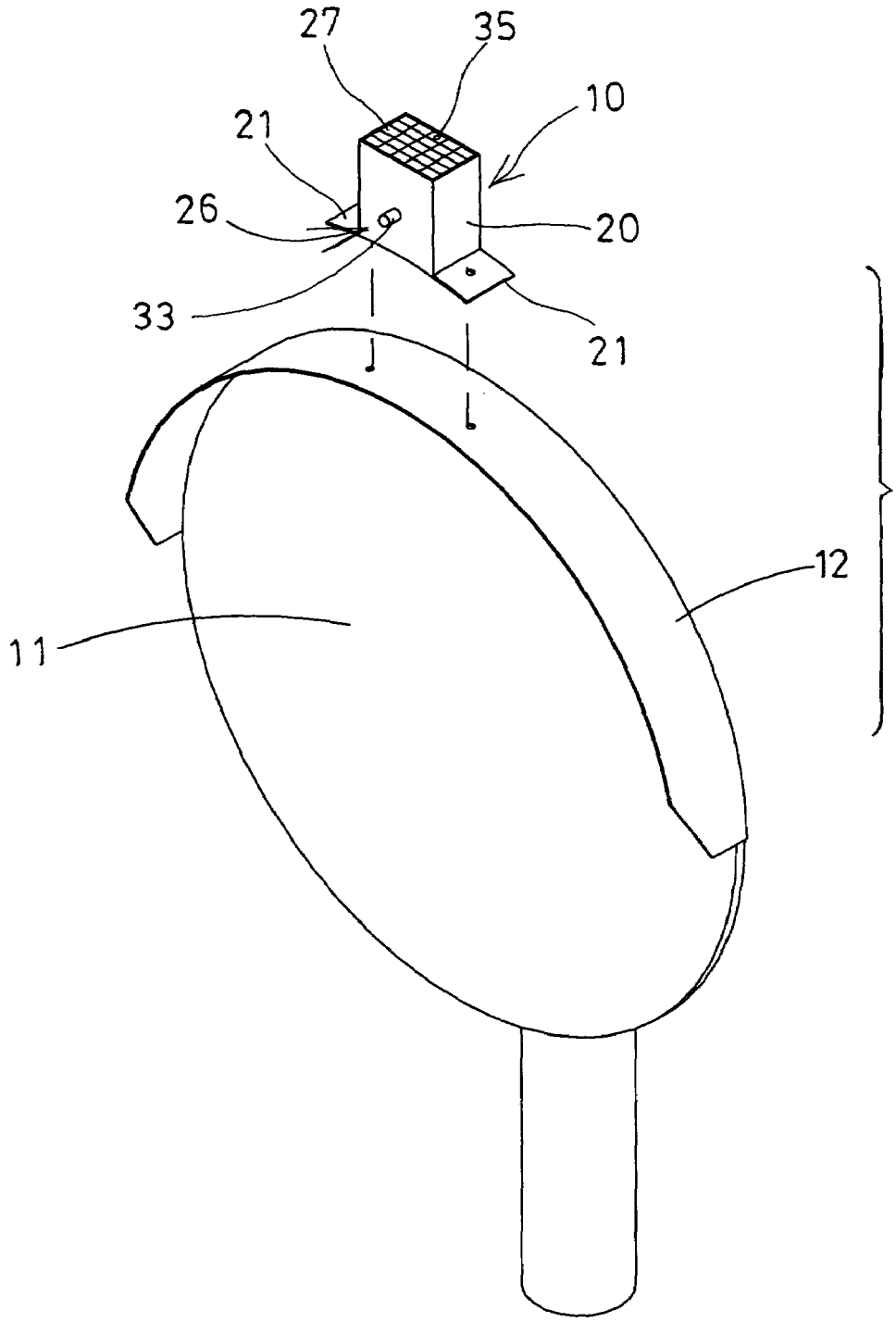
FIG. 2 is a partial exploded view of the solar powered warning light device and the supporting object.

Referring to the drawings, and initially to FIGS. 1 and 2, a solar powered warning light device 10 in accordance with the present invention comprises a supporting device 11, such as a convex mirror 11 which typically includes a shield or a hood 12 disposed thereon, to cover and to shield the convex mirror 11, and to prevent the convex mirror 11 from being wetted or damaged by rains and sun shines.

The warning light device 10 further includes a housing 20 having one or more flaps 21 laterally extended therefrom, for attaching onto and for securing to the supporting device 11, such as the hood 12 of the supporting device 11 with such as fasteners 22 (FIG. 1), for allowing the warning light device 10 to be attached onto and supported on the supporting device 11.

Figure 3:
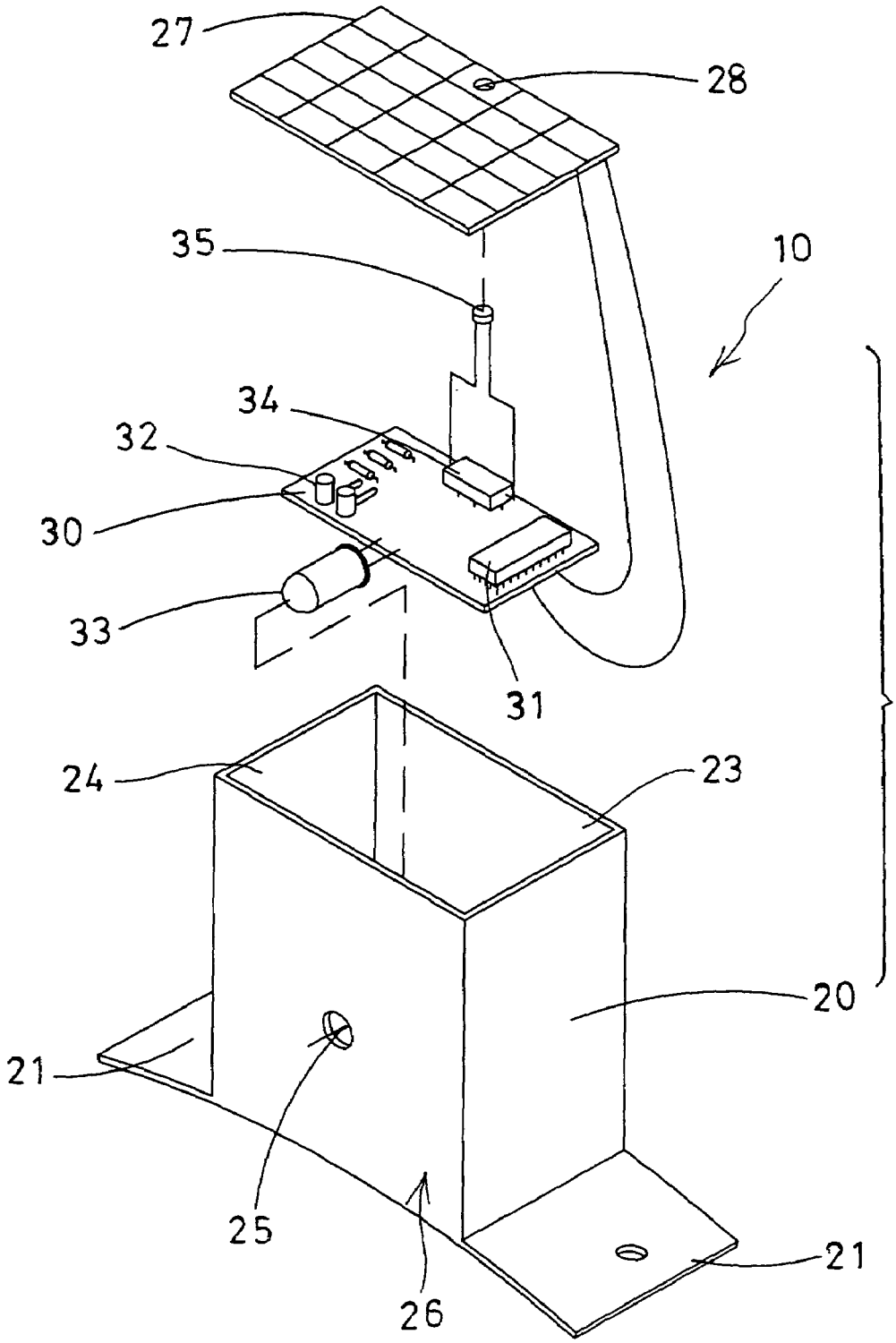
FIG. 3 is an exploded view of the solar powered warning light device.

As shown in FIG. 3, the housing 20 includes a chamber 23 formed therein and having an open top 24, and includes an orifice 25 formed in the front portion 26 thereof, and communicating with the chamber 23 of the housing 20. A solar cell array or solar panel 27 is disposed on top of the housing 20 or received or engaged in the open top 24 of the housing 20, and includes an aperture 28 formed therein.

A control circuit board 30 is disposed in the chamber 23 of the housing 20 and includes a converting device 31 disposed thereon and coupled to the solar panel 27, to receive the solar energy from the solar panel 27, and to convert the solar energy into electric energy, and includes an electric energy storing device 32, such as one or more capacitors 32 or the like, coupled to the converting device 31, to receive the electric energy from the converting device 31.

The circuit board 30 further includes one or more light devices 33 disposed thereon, and coupled to the capacitors or the electric energy storing device 32 via an electric switch 34 which may be used to control the light devices 33, or to switch on and off the light devices 33. The light devices 33 may be received in or engaged out or through the orifice 25 of the housing 20, to generate and to emit a light out through the housing 20, and to light the dark environment, particularly the dark corner areas of the roads.

The circuit board 30 further includes a photo-resistor or a photoactive member 35 coupled to the electric switch 34, and preferably engaged or received in the aperture 28 of the solar panel 27, for allowing the photo-resistor or the photoactive member 35 to be actuated or operated by the light or sun shine of the environment, and in order to actuate or to operate the switch 34, and then to switch on and off the light devices 33.

In operation, the solar panel 27 may be used to absorb or to receive the solar energy, and the converting device 31 may receive the solar energy from the solar panel 27 and may convert the solar energy into electric energy, which may then be transmitted to and stored in the electric energy storing device 32, such as the capacitors 32, for energizing the light devices 33.

When the environment has a strong sun shine or has a light good enough to actuate the photo-resistor or the photoactive member 35, the impedance of the photo-resistor or the photoactive member 35 may be increased and/or maintained in a high level, in order to switch off the switch 34, and then to switch off the light devices 33.

On the contrary, when the environment is dark or has a light that is not good enough to actuate the photo-resistor or the photoactive member 35, the impedance of the photo-resistor or the photoactive member 35 may be decreased and/or maintained in a low level. At this moment, the switch 34 may be switched on, and then the light devices 33 may also be switched on, in order to light the dark environment, particularly the dark corner areas of the roads. The users or the drivers may easily see or view the dark corner areas of the roads and/or may clearly see the convex mirror 11.

It is to be noted that the light devices 33 may be selectively energized by the electric energy stored in the electric energy storing device 32, such that the light devices 33 may be energized without batteries, and such that the light devices 33 may be energized as long as possible. In addition, the light devices 33 may be engaged out through the orifice 25 of the housing 20, and may light the dark environment, particularly the dark corner areas of the roads, for allowing the drivers to clearly see the convex mirror 11, and to clearly note or watch vehicles from the other sides of the corner areas.

Accordingly, the solar powered warning light device in accordance with the present invention may be provided for attaching onto objects to light environment without batteries, and for lighting the dark environment, particularly the dark corner areas of the roads, and to avoid or to prevent car accidents from being happened.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A solar powered warning light device comprising:

a convex mirror including a hood provided on top thereof, a housing disposed on said hood of said convex mirror and including at least one flap extended therefrom and engaged and secured onto said hood, and including a chamber formed therein, and including an orifice formed in a front portion thereof, and communicating with said chamber of said housing, and including an open top formed therein, a solar panel disposed on top of said housing and received and engaged in said open top of said housing, to receive solar energy, a circuit board disposed in said chamber of said housing and including a converting device disposed thereon and coupled to said solar panel, to receive solar energy from said solar panel, and to convert the solar energy into electric energy, and including an electric energy storing device having at least one capacitor coupled to said converting device, to receive and to store the electric energy from said converting device, said circuit board including at least one light device coupled to said electric energy storing device and energized by said electric energy storing device, said at least one light device being engaged in said orifice of said housing, to generate and to emit a light out through said housing, and to light dark environment, an electric switch coupled to said at least one light device, to switch on and off said at least one light device, and a photoactive member coupled to said electric switch, and to be actuated by a light of the environment, in order to operate said electric switch, and then to switch on and off said at least one light device depending on the light of the environment.

2. The solar powered warning light device as claimed in claim 1, wherein said solar panel includes an aperture formed therein, to receive said photoactive member, and to allow said photoactive member to be actuated by the light of the environment.

* * * * *